US005588531A

United States Patent [19]

Yoshida et al.

[11] Patent Number: 5,588,531

[45] Date of Patent: Dec. 31, 1996

[54] GLASS SUBSTRATE TRANSPORT BOX

[75] Inventors: Toshio Yoshida, Osaka; Toshio Akai, Kyoto, both of Japan

[73] Assignees: Yodogawa Kasei Kabushiki Kaisha; Sharp Kabushiki Kaisha, both of Osaka, Japan

[21] Appl. No.: 337,424

[22] Filed: Nov. 8, 1994

[30] Foreign Application Priority Data

Nov. 9, 1993 [JP] Japan ..... 5-304668

[51] Int. Cl.[6] ..... B65D 85/48

[52] U.S. Cl. ..... 206/454; 206/523; 206/719; 428/36.5

[58] Field of Search ..... 206/328, 334, 206/710, 711, 523, 454, 719; 428/36.5; 521/159

[56] References Cited

U.S. PATENT DOCUMENTS

| | | | |
|---|---|---|---|
| 4,747,488 | 5/1988 | Kikuchi | 206/711 |
| 4,798,305 | 1/1989 | Laverty | 206/334 |
| 4,943,459 | 7/1990 | Nedzu | 428/36.5 |
| 5,314,927 | 5/1994 | Kondo et al. | 521/159 |
| 5,366,080 | 11/1994 | Carstersen et al. | 206/334 |

FOREIGN PATENT DOCUMENTS

| | | | |
|---|---|---|---|
| 1196372 | 11/1985 | Canada | 206/334 |
| 62-276849 | 12/1987 | Japan . | |

*Primary Examiner*—Jimmy G. Foster

*Attorney, Agent, or Firm*—Armstrong, Westerman, Hattori, McLeland, & Naughton

[57] ABSTRACT

A glass substrate transport box which is easy to handle and transported and adapted to protect glass substrates is provided at drastically reduced production cost. At least the body of the box is a molded piece of resin foam with a foaming ratio of 3–30, e.g. polyolefin foam, which has grooves for supporting glass substrates on at least a pair of its opposed inside walls. Preferably the inside wall of the body has a relatively dense skin layer. The resin foam may contain an electrically conductive polymer or an antistatic agent.

2 Claims, 2 Drawing Sheets

GLASS SUBSTRATE TRANSPORT BOX

FIELD OF THE INVENTION

This invention relates to a glass substrate transport box for use in the transport of glass substrates inclusive of glass blanks, liquid crystal display panel glass substrates, plasma display panel glass substrates, fluorescent display tube glass substrates, thermal head glass substrates, color filter or other glass substrates, and panels fabricated using such glass substrates.

BACKGROUND OF THE INVENTION

For the transport of glass substrates (inclusive of finished panels) from and to the glass manufacturer, color filter manufacturer and device manufacturer, glass substrate transport boxes manufactured by the injection-molding of various resins, such as ABS resin and polyvinyl chloride resin, or the assembling of members molded from such resins are in use. For the transport of glass substrates equipped with printed circuits, such as glass substrates carrying thin-film transistors (TFT), or complete liquid crystal cell panels, injection-molded or assembled boxes manufactured using a resin composition containing an electrically conductive polymer or an antistatic agent are employed.

The typical glass substrate transport box comprises a bottomed body and a lid, with the two opposed side walls of the body being formed with grooves for supporting glass substrates in a parallel array with a clearance provided between adjacent grooves for isolation of the substrates from one another in a vertical or horizontal position.

The typical glass substrate transport box accepts ten and odds to tens of glass substrates. The box is sometimes provided with a purging port for replacing the internal atmosphere with an inert gas such as $N_2$.

While the injection-molded or assembled resin box heretofore used for the transport of glass substrates is capable of keeping glass substrates gas-tight, even the dead weight of the box itself is so great, for example 5–6 kg, that it cannot be easily handled in relocating, stacking or shipment.

Furthermore, the resin box manufactured by injection molding is lacking in cushioning characteristics and, therefore, virtually cannot absorb the shock and impact on dropping so that the glass substrates accommodated therein may break or the box itself may be damaged.

Furthermore, since the injection-molded resin box has a high heat conductivity of, for example, 0.26 Kcal/m.hr.°C., TFT-mounted glass substrates or finished panels may experience temperature buildups due to the poor heat insulation of the box during transport and the consequent dew condensation stains the glass substrates or impairs the circuits, thus detracting from the reliability of the products.

In addition, the combined manufacturing cost of the injection molds required for the molding of the body and lid of the box may amount to, for example, 15 million~20 million yen and the amount of resin required may be as large as, for example, 5–6 kg per box. Therefore, the total cost of the injection molds and resin material amounts to a considerable sum.

OBJECT AND SUMMARY OF THE INVENTION

Under the circumstances, this invention has for its object to provide a glass substrate transport box which is easy to handle, improved in transportability and in the protection of glass substrates, and which can be manufactured at a markedly reduced cost compared with any of the conventional boxes.

The glass substrate transport box of this invention is characterized in that at least the body of the box is made of a resin foam, preferably a polyolefin foam, blown to a foaming ratio of 3–30, and that a pair of opposed inner sides of said body are formed with grooves for supporting glass substrates.

DETAILED DESCRIPTION OF THE INVENTION

Figure 1:
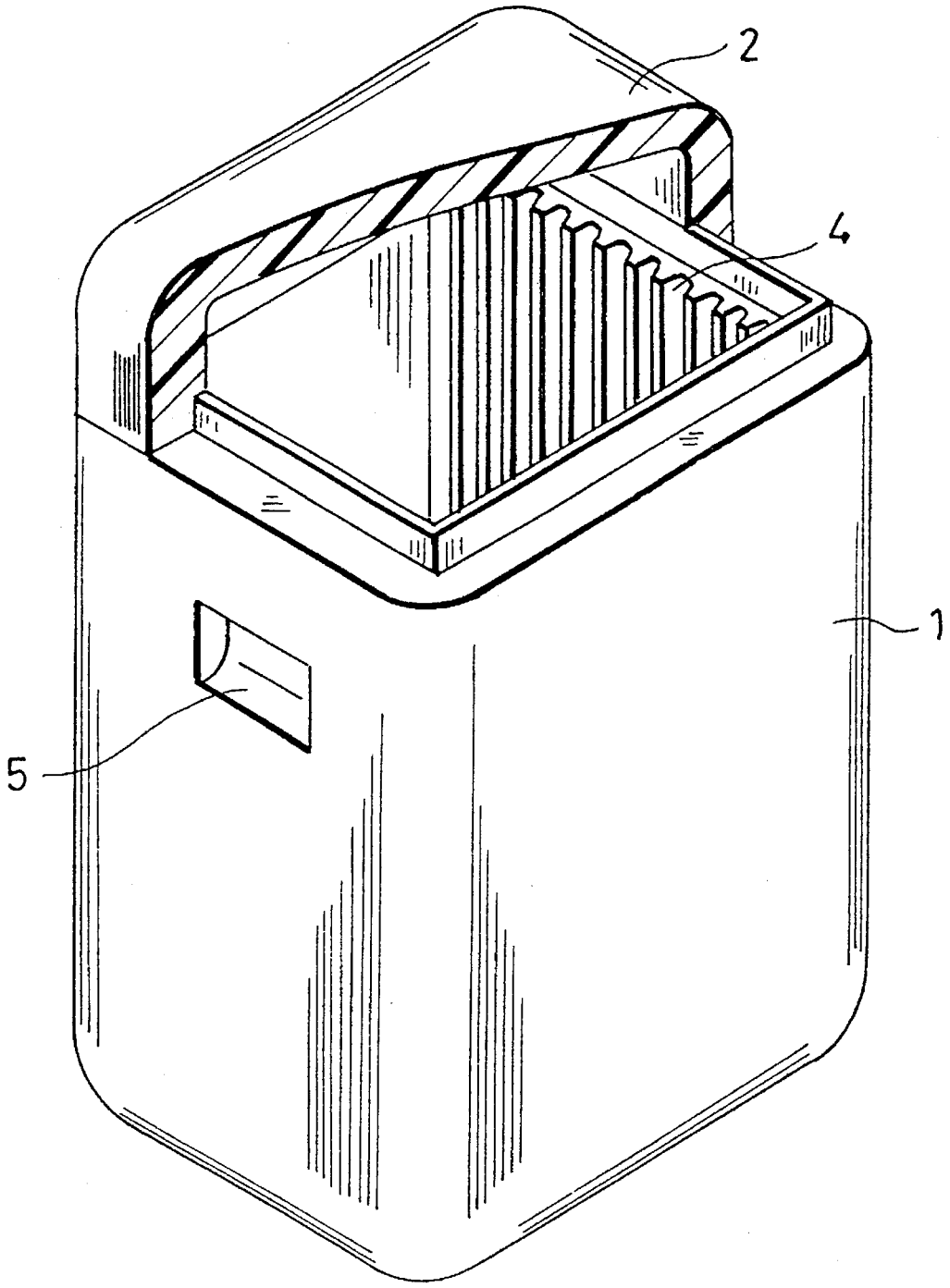
FIG. 1 is a perspective view showing one example of the glass substrate transport box according to this invention, with its lid being shown partially exploded.

Of the glass substrate transport box according to this invention, at least a body 1 is made of a resin foam blown to a foaming ratio of 3–30.

While a variety of resin foams can be used for the manufacture of said body 1, olefinic resin foams are most suited for the purpose. The olefinic resin foam includes ethylene series polymer foams such as low density polyethylene foam, high density polyethylene foam, ethylene-vinyl acetate copolymer foam, ionomer foams and olefinic polymer blend foams, polypropylene foam and so on.

The foaming ratio of such resin foam should be 3–30 or preferably 4–25. If the foaming ratio is less than 3, the objectives of weight reduction, protection (cushioning) of glass substrates, and thermal insulation cannot be sufficiently accomplished, while a foaming ratio over 30 results in insufficient mechanical strength and excessive resiliency.

A typical preferred process for producing such a resin foam comprises filling a metal mold with polyolefin beads containing a blowing agent or a primary foam obtained from such beads and heating the mold at a predetermined temperature. The blowing agent may be an evaporation type blowing agent or a chemical decomposition type blowing agent. If necessary, two or more different blowing agents can be used in combination. Since the bead foaming process is a low-pressure process, a low-cost mold made of, for example, aluminum can be employed. Of course, in lieu of the bead foaming process, other foaming processes can likewise be employed.

The box of this invention comprises either a bottomed body 1 and a lid 2 or an open-bottom body 1, a lid 2 and a bottom member 3. Preferably the lid 2 and bottom member 3 are also made of resin form. From strength points of view, the thickness of the respective members of the box is preferably about 15–100 mm.

A pair of opposed inner side walls of the body 1 is formed with grooves 4 for supporting glass substrates in the foaming process. The other pair of opposed inner sides of the body 1 is usually not provided with such grooves but may be formed with grooves for accommodating glass substrates of other dimensions. The lid 2 and bottom member 3 need not be provided with grooves but, if required, may also be formed with grooves.

The grooves 4 mentioned above should be of sufficient depth and width to accept the edges of glass substrates with some clearance allowing a small play of the glass substrates.

The number of grooves can be chosen according to the need but in consideration of the necessary number of glass substrates to be stowed and the total weight of the box as loaded with glass substrates to capacity, each box is generally provided with about 15–50 grooves on either side. As to the geometry of such grooves, the edge of each groove is preferably round or tapered.

The inner side (inner and outer sides) of the wall of the body is preferably greater in density than the interior portion of the wall. For example, a dense skin can be formed on the wall surface contacting the mold by carrying out post-heating in the blowing process. The relative density of such skin structure down to 1 mm from the surface is preferably at least 1.5 times, or more preferably at least 2 times, as great as the interior density (which is approximately 0.1 when the foaming ratio is 10). It is preferable that each of the surface of the lid 2 and that of the bottom member 3 also have a similar skin structure. The selective increase of surface density is useful for suppression of dust generation and improvement of strength.

The inner side of the lid 2 and the inner side of the bottom member 3 may each be provided with a retainer 6 for preventing rattling of accommodated glass substrates. The retainer 6 may for example be a member made of polytetrafluoroethylene or high molecular polyethylene or a laminate member consisting of such a polymer and a rubber or elastomer with the former being disposed on the face side. The retainer 6 may for example be a mere plate, a post, or a cylindrical member. It is preferable to provide some means for fixing the retainer 6 rigidly in position. For example, the inner side of the lid 2 (or the inner side of the bottom member 3) is preferably formed with projections 7 in the blowing process and the retainer means 6 may be provided with holes 8 corresponding to said projections.

When the intended use of the box requires purging of the box with an inert gas, the body 1 or the lid 2 is provided with a gas passageway 9 in a suitable position.

For accommodation of TFT-formed glass substrates or complete liquid crystal cell panels, at least the body 1 of the box is preferably a foamed resin element having a volume resistivity of $10^3$–$10^{12}$ Ω·cm as obtained by, for example, blowing a resin composition containing an electrically conductive polymer or an antistatic agent. In this manner, the necessary antistatic properties can be provided.

Since the resin foam members have a high frictional coefficient with respect to each other, a sufficiently tight engagement can be easily established between the body 1 and the lid 2 (and the bottom member) by snapping one onto the other. However, where an inert gas purging is to be performed, it is good practice to provide the mating parts of the two members with corrugations or wave-like formations to increase the contact area or, where necessary, to further provide each corrugated area with a sealing film 10.

If required, after placement of glass substrates in the body 1 of the box and setting the lid 2 (and the bottom member 3) in position on the body 1, a flush fastener or the like can be applied to preclude accidental disengagement of the lid 2 (and bottom member 3) from the body 1.

For shipment (e.g. export) to a distant destination, the whole box loaded with glass substrates may be packaged with a moisture-proof packaging material, such as polyolefin film or aluminum-laminate resin film and/or taped. In such packaging, a desiccant such as silica gel may be placed inside.

In using the glass substrate transfer box of this invention, all that is necessary is to fit glass substrates into the wall grooves of the body 1, set the lid 2 (and bottom member 3) in position on the body 1, and release the box for shipment or storage. To take out the glass substrates, the lid 2 (and/or bottom member 3) is simply removed. Loading of the box with glass substrates can be performed manually or automatically with a robot. Loading and unloading can be carried out with the box held in a vertical position or in a horizontal position. The same applies to shipment or storage.

Because at least the body 1 is made of resin foam (particularly a polyolefin foam), the glass substrate transport box of this invention is by far lighter in weight than the conventional injection-molded resin box (1/15 when the foaming ratio is 15). Therefore, it can be easily handled in dislocating, stacking and shipment. Moreover, because of its good cushioning characteristics, glass substrates are well protected against damage even if the box is dropped or subjected to shock and vibrations and the damage to the box itself is also effectively prevented.

Polyolefin foams are particularly advantageous in that they are high in strength, tear resistance and abrasion resistance, do not give off dusts, and can be washed with water.

Furthermore, since a resin foam generally is a good thermal insulator (e.g. the heat conductivity of a polyolefin foam with a foaming ratio of 15 is about 0.036–0.038 kcal/m-hr.°C.), the temperature increase of glass substrates and the dew condensation on the substrates are effectively prevented. Therefore, it does not occur that the reliability of glass substrates is adversely affected by water stains or circuit failure.

Since the box is made of resin foam, the resin consumption per box is greatly reduced. Thus, assuming that the production of an injection-molded resin box consumes 6 kg of resin, the resin required for a comparable box of resin foam with a foaming ratio of 15 is 0.4 kg). Therefore, the cost of production is as much reduced. In addition, since the resin foam can be produced using an inexpensive mold, for example an aluminum mold, the mold cost is also drastically reduced. Incidentally, this mold cost is about 1/5–1/6 of the cost of the usual injection mold.

When at least the body 1 of the box is made of a resin foam with a volume resistivity of $10^3$–$10^{12}$ Ω·cm as molded from a resin composition containing an electrically conductive polymer or an antistatic agent, static charging of glass substrates during loading and unloading or transport can be effectively prevented. Even if charging occurs, the above range of volume resistivity provides for an attenuation time of 0.5–1 second and this gradual attenuation does not cause a circuit failure.

The following examples are intended to describe this invention in further detail and should by no means be construed as defining the scope of the invention.

EXAMPLE 1

FIG. 1 is a perspective view showing a glass substrate transport box embodying the principle of this invention. Here, the lid 2 is shown as partially exploded.

Foamable polyethylene beads were subjected to preliminary foaming with gas and the gas was replaced with air. After this primary foam was set in an aluminum mold, 4 kg/cm$^2$ of steam was blown in one shot for molding and, then, post-heating was performed at 60° C. to provide a bottomed body 1 as illustrated in FIG. 1. The same procedure was repeated to provide a lid 2. The thickness of the body 1 and lid 2 was 40 mm. The resin foam thus obtained was a substantially closed-cell structure. The reference numeral 5 indicates a pair of handling recesses provided on both sides of the body 1.

While the foaming ratio of this resin foam as a whole was 12, the foaming ratio down to a depth of 1 mm from its inner and outer surfaces was 4–5. Thus, the body 1 had a skin layer on either surface. In the abrasion test using a Taber abrader, both surfaces of the foam showed good abrasion resistance. Thus, the surface was not injured when it was scratched with the pointed end of a nail, nor gave a dust when the surface was injured by force.

This box not only met the strength requirements but was considerably superior to the conventional injection-molded or assembled resin box in weight, ease of handling, transportability, protection of glass substrates and production cost.

EXAMPLE 2

The procedure of Example 1 was repeated except that a foamable polypropylene of electrically conductive grade containing 20 weight % of carbon black was used. As a result, a body 1 and a lid 2 each consisting in a resin foam having a hard skin were obtained. These members showed characteristics comparable to those obtained in Example 1. The volume resistivity (ASTM D257) on both surfaces of this resin foam was $10^4$–$10^5$ Ω·cm.

The glass substrate transport box thus manufactured is suited for the delivery, shipment or storage of TFT-mounted glass substrates and finished LC cell panels.

EXAMPLE 3

Figure 2:
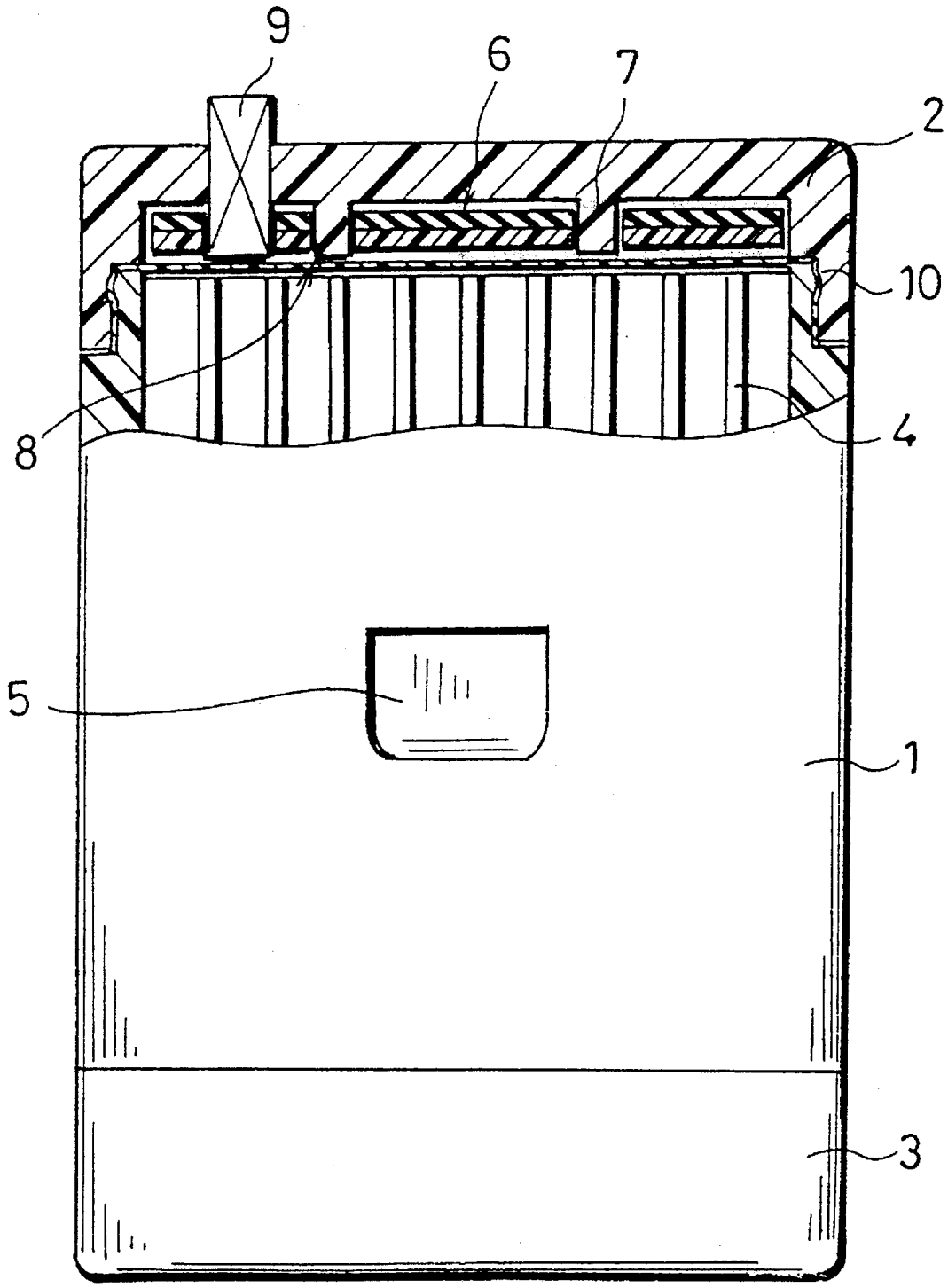
FIG. 2 is a partially exploded front view showing another example of the glass substrate transport box according to this invention.

FIG. 2 is a partially exploded front view showing another glass substrate transport box embodying the principle of this invention.

A foamable polypropylene was foamed in aluminum molds to provide a bottomless body 1, a lid 2 and a bottom member 3. The wall thickness was invariably 35 mm. The foam had a substantially closed-cell structure.

While the foaming ratio of the whole resin foam was 6, the foaming ratio down to a depth of 1 mm from the inner or outer surface was 2–2.5. Thus, the resin foam had a skin layer on either surface. As tested with a Taber abrader, the resin foam showed good abrasion resistance.

The mating parts of the body 1, lid 2 and bottom member 3 were respectively formed with a wavy formation in the foaming operation and a sealing thin film 10 of foam silicone was formed on the wavy formation to provide for an improved sealing effect.

The lid 2 and bottom member 3 were respectively formed with projections 7 in the foaming process and a rectangular retainer 6 separately prepared (a laminate of polytetrafluoroethylene on the inner side of the box with acrylonitrile-butadiene rubber on the opposite side) was mounted in position with its engaging hole 8 being mated with the corresponding projection 7. The lid 2 was subsequently formed with a gas inlet 9.

This box not only met the strength requirements but was considerably superior to the conventional injection-molded or assembled resin box in weight, ease of handling, transportability, protection of glass substrates, and production cost.

Thus, the glass substrate transport box of this invention has necessary strength and rigidity and high abrasion and scratch resistance, giving no dust, and is by far superior to the conventional injection-molded or assembled resin box in ease of handling, transportability, protection of glass substrates and production cost. Moreover, it can be cleaned by flushing with water.

What is claimed is:

1. In a glass substrate transport box comprising either (A) a generally rectangular, bottomed body and a lid or (B) a generally rectangular, unbottomed body, a lid and a bottom member, said bottomed or unbottomed body having grooves on at least one pair of its opposed inner walls for supporting glass substrates, the improvement wherein each of said body, lid and bottom member is a molded piece of polyolefin foam with a foaming ratio of 4–25 as a whole, inner and outer sides of the wall of said body, lid and bottom member have a dense skin layer relative to the interior portion of the wall, where a relative density of the skin layer down to a depth of 1 mm from the surface is at least 2 times as great as the interior portion density of the wall, and said polyolefin foams are those obtained by filling metal mold with polyolefin beads containing a blowing agent or a primary foam obtained from such beads and heating the mold.

2. The glass substrate transport box according to claim 1 wherein said resin foam has a volume resistivity of $10^3$–$10^{12}$ Ω·cm.

* * * * *